US010177484B2

(12) United States Patent
Schönfeld et al.

(10) Patent No.: US 10,177,484 B2
(45) Date of Patent: Jan. 8, 2019

(54) HOLDING FRAME FOR HOLDING PLUG CONNECTOR MODULES

(71) Applicant: HARTING Electric GmbH & Co. KG, Espelkamp (DE)

(72) Inventors: Alexander Schönfeld, Osnabrück (DE); Heiko Herbrechtsmeier, Bünde (DE); Heiko Meier, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 15/775,766

(22) PCT Filed: Nov. 10, 2016

(86) PCT No.: PCT/EP2016/077226
§ 371 (c)(1),
(2) Date: May 11, 2018

(87) PCT Pub. No.: WO2017/084954
PCT Pub. Date: May 26, 2017

(65) Prior Publication Data

US 2018/0269622 A1 Sep. 20, 2018

(30) Foreign Application Priority Data

Nov. 16, 2015 (DE) ..... 10 2015 222 561

(51) Int. Cl.
*H01R 13/502* (2006.01)
*H01R 13/518* (2006.01)
*H01R 13/514* (2006.01)

(52) U.S. Cl.
CPC ..... *H01R 13/518* (2013.01); *H01R 13/514* (2013.01)

(58) Field of Classification Search
CPC ..... H01R 13/514; H01R 9/26; H01R 13/518; H01R 23/025
(Continued)

(56) References Cited

U.S. PATENT DOCUMENTS 6,004,162 A 12/1999 Harting et al.
7,322,842 B2 * 1/2008 Duck ..... G02B 6/381 200/51.03
(Continued)

FOREIGN PATENT DOCUMENTS

CN 201656162 U 11/2010
CN 202084755 U 12/2011
(Continued)

OTHER PUBLICATIONS

International Search Report and Written Opinion, dated Feb. 21, 2017, for International Application No. PCT/EP2016/077226, 11 pages. (with English Translation of Search Report).
(Continued)

*Primary Examiner* — Phuong Chi T Nguyen
(74) *Attorney, Agent, or Firm* — Seed IP Law Group LLP

(57) ABSTRACT

The disclosure relates to a holding frame for holding plug connector modules, in particular for installation in plug connector casings and/or for screwing onto wall surfaces. In order to allow improved handling and more reliable populating and assembly of the holding frame comprising frame halves, it is proposed that the holding frame in the plug-in state has a stop for stopping the plug connector module on insertion into the holding frame, wherein the stop is so designed that when a plug connector module is stopped in the plug-in state, holding frame holding devices and plug module holding devices engage in each other in the holding state.

16 Claims, 5 Drawing Sheets

(58) Field of Classification Search
USPC ..... 439/701, 716, 532, 540.1
See application file for complete search history.

(56) References Cited

U.S. PATENT DOCUMENTS

| | | | | |
|---|---|---|---|---|
| 9,502,813 | B2 * | 11/2016 | Dugo | H01R 9/2408 |
| 9,847,608 | B2 * | 12/2017 | Bruex | H01R 13/514 |
| 2017/0237209 | A1 * | 8/2017 | Loetkemann | H01R 13/518<br>439/540.1 |
| 2018/0026405 | A1 * | 1/2018 | Schlepp | H01R 13/73<br>439/540.1 |

FOREIGN PATENT DOCUMENTS

| | | |
|---|---|---|
| CN | 204205152 U | 3/2015 |
| DE | 197 07 120 C1 | 6/1998 |

OTHER PUBLICATIONS

Harting Elektronik GmbH, "Schwere Steckverbinder Han-Modular®," Product Catalog, Jan. 1999, 44 pages.

* cited by examiner

HOLDING FRAME FOR HOLDING PLUG CONNECTOR MODULES

TECHNICAL FIELD

The disclosure relates to a holding frame for holding plug connector modules, in particular for installation in plug connector casings and/or for screwing onto wall surfaces, wherein said plug connector modules are inserted into the holding frame, and holding devices or means on the plug connector modules, for example, cooperate with recesses which are provided on opposite wall parts (side parts) of the holding frame. The disclosure also relates to a corresponding system, production method and to a method for populating such a holding frame.

BACKGROUND

Description of the Related Art

Holding frames of the aforementioned kind are used for holding plug connector modules, the holding frame being populated with different plug connector modules and subsequently inserted into a plug connector casing and fastened thereto. The holding frame must be mechanically stable in order to withstand the insertion and withdrawal forces that arise when forming or separating the plug connection.

A substantially rectangular holding frame provided with side walls extending at right angles to the mounting plane is known from the document entitled "Schwere Steckverbinder, Han-Modular 3" published by the firm of Harting Elektronik GmbH. The plug connector modules are provided with detent hooks which snap into the side walls when the plug connector modules are inserted into the holding frame, and are thus held securely in the latter.

Only with special removal tools is it then possible to replace the plug connector modules, i.e., to remove or release them.

A development of that solution is described in DE 19707120 C1 and EP 0860906 A2, in which a holding frame is disclosed. The object of the invention disclosed in DE 19707120 C1 and EP 0860906 A2 is that the plug connector modules can be installed and dismounted in the simplest possible manner. However, the intention is nevertheless to ensure that the holding frame has a high level of mechanical stability in order to withstand the insertion and withdrawal forces that arise when forming or separating the plug connection.

The holding frame described therein consists of two frame halves which are connected to each other by hinges and have fastening ends provided with fastening screws. The hinges are provided at the fastening ends of the holding frame, and the frame halves are able to pivot transversely to the side parts of the holding frame. To form the hinges, molded portions which engage in matching recesses are provided in each case at the fastening ends of the holding frame or of the side parts.

In the holding frame or articulated frame disclosed in DE 19707120 C1 or EP 0860906 A2, a wide opening angle for populating the frame is known, which makes it easier for the plug connector modules to slip through the holding frame during installation. This makes installation cumbersome and tedious, particularly when several plug connector modules are being installed in one holding frame.

BRIEF SUMMARY

Embodiments of the present invention provide a holding frame in such a way that problems associated with known holding frames encountered during installation are surmounted or at least mitigated, the specific aim being to provide improved handling and a more reliable way of populating and installing the holding frame.

According to one aspect of the disclosure, a holding frame for holding plug connector modules is proposed, wherein said plug connector modules are inserted into the holding frame, and plug module holding devices or means on the plug connector modules cooperate with plug module holding devices or means which are provided on opposite side parts of the holding frame, wherein the holding frame includes two holding frame areas articulatedly connected to each other at fastening ends of the holding frame, the holding frame being divided along a line parallel to the side parts of the holding frame, the hinged connection allowing a plug-in state and a holding state of the holding frame, the frame halves in the plug-in state being pivoted in relation to each other about a longitudinal axis in such a way that one or more plug connector modules can be inserted between the side parts, and the frame halves in the holding state being pivoted in such a way relative to the plug-in state that one or more inserted plug connector modules have a form-locking connection with the holding frame via the holding devices or means, and wherein the holding frame in the plug-in state has a stop for stopping the one or more plug connector modules on insertion into the holding frame, wherein the stop is so designed that when a plug connector module is stopped in the plug-in state, the holding frame holding devices or means and the plug module holding devices or means engage in each other in the holding state.

According to another aspect of the disclosure, a holding system for holding plug connector modules is proposed, the holding system comprising a holding frame as described above and one or more plug connector modules, wherein the plug connector modules have plug module holding devices or means, wherein the holding frame is designed such that the plug module holding devices or means and the holding frame holding devices or means engage in each other in a holding state.

In another aspect of the disclosure, a method for populating a holding frame with plug connector modules is proposed, in particular for populating a holding frame according to one or more embodiments of the invention, wherein the holding frame comprises two frame halves, the holding frame being divided along a line parallel to the side parts of the holding frame, said method comprising: providing a plug-in state of the holding frame, the frame halves articulatedly connected to each other at fastening ends of the holding frame in the plug-in state being pivoted in relation to each other about a longitudinal axis in such a way that one or more plug connector modules can be inserted between the side parts, populating the holding frame in the plug-in state with one or more plug connector modules by inserting one or more plug connector modules as far as a stop, and providing a holding state of the holding frame by pivoting the frame halves relative to the plug-in state, such that the one or more inserted plug connector modules have a form-locking connection with the holding frame via plug module holding devices or means on the plug connector modules and via holding frame holding devices or means which are provided on opposite side parts of the holding frame, the one or more plug connector modules remaining at the stop when pivoted.

It has been found that the problems which arise with the holding or articulated frame disclosed in DE 19707120 C1 or EP 0860906 A2 arise because the opening of the holding or articulated frame in the open state in which the modules are to be installed is not defined unambiguously, with the consequence that the modules can slip through the holding or articulated frame in that state. Installation can sometimes be cumbersome as a result, particularly when installing several modules in one holding or articulated frame.

In this context, the inventors set themselves the aim of defining the opening of the holding frames in the open position in such a way that any slipping of the modules being installed is prevented and that installation of several modules in a holding frame is generally simplified.

The opening of the holding frame in the plug-in state is preferably defined by the constructional design of the frame halves, that is to say, in such a way that parts of the frame halves in the respective state have clearly defined spacings from the respective identical parts of the opposite frame halves and such that any exceeding of the clearly defined spacings is prevented due to the constructional design.

In one advantageous embodiment, the stop is located on the lower edge, in the plug-in direction, of the holding frame holding devices or means.

Due to the stop of a plug connector module lying at the lower edge, in the plug-in direction, of the holding frame holding devices or means, it is possible to prevent the plug module holding devices or means of the plug connector modules from slipping under the holding frame holding devices or means during installation, or also to prevent a plug connector module from slipping entirely out of the holding frame. In that regard, the holding frame is so designed that, when pivoting the holding frame halves from the plug-in state to the holding state, the plug module holding devices or means slide along the stop until the holding frame holding devices or means and the plug module holding devices or means engage in each other.

In another advantageous embodiment, the stop in the plug-in state is defined by a first opening width, the first opening width being a width between two opposite lower edges of the plug module holding devices or means in the plug-in state.

By defining the stop in the plug-in state in terms of a first opening width, it is possible to ensure that the installation problems described in the foregoing are unable to occur, due to the constructional design of the holding frame.

In another advantageous embodiment, the holding frame has a second opening width in the plug-in state, the second opening width being defined by the width between two opposite upper edges of the plug module holding devices or means, in the plug-in direction, wherein the second opening width is wider than the first opening width.

Due to a precisely defined second opening width being defined for a plug-in state of the holding frame, and the second opening width being greater than the first opening width, easy installation of the plug connector modules is ensured.

In another advantageous embodiment, the first opening width is less than a dimension between two opposite outer edges of the plug module holding devices or means, and the second opening width is greater than the dimension between two opposite outer edges of the plug module holding devices or means.

Defining the opening widths based on the dimensions of the plug module holding devices or means ensures that the opening widths guarantee easy installation of the plug connector modules in the holding frame.

In yet another advantageous embodiment, the holding frame has a third opening width in the plug-in state, the third opening width being defined on the basis of the smallest distance between the opposite side parts in the plug-in direction, wherein the third opening width is defined by the width of the main part of the plug connector module.

This clear definition of a third opening width, based on the plug connector module, ensures that the holding frame is designed to ensure easy installation of the respective plug connector modules.

In one variant of the above embodiment, the first opening width is between 30.4 mm and 34.2 mm, the second opening width is 34.4 mm and the third opening width is 30.3 mm.

In another advantageous embodiment, the hinged connection is shaped in such a way that the predetermined opening widths cannot be exceeded.

Designing the hinged connection constructionally so that the opening widths cannot be exceeded ensures that the advantageous opening widths are not exceeded or fallen short of during installation.

In another advantageous embodiment, the hinged connection has a first boundary and a second boundary, the first boundary belonging to the first side part and the second boundary belonging to the second side part, such that the first and the second boundary come into contact when the holding frame is in the plug-in state.

This ensures, by simple mechanical means or design, that the hinged connection can only be opened until there is contact between the two boundaries.

In one variant of the above embodiment, the boundaries define an angle to the side surfaces such that the predetermined opening widths are not exceeded in the plug-in state.

Selecting the angle between the boundaries and the side surfaces so that the boundaries come into contact with each other in the plug-in state in such a way that further opening is not possible ensures that the advantageous opening widths cannot be exceeded inadvertently during installation.

In another advantageous embodiment, the holding frame holding devices or means have a lower cut surface perpendicular to the surface of the side parts, on the lower edge in the plug-in direction. This has the advantage that a clear definition of the stop of the plug connector module is possible.

In another advantageous embodiment, the one or more plug connector modules have detent hooks, and the stop is selected such that, when the one or more plug connector modules are stopped, the detent hooks of the one or more plug connector modules catch on lower edges of the side parts.

This embodiment has the advantage that, in the plug-in state and when in contact with the stop, the plug connector modules cannot slip further in the plug-in direction or slip out of the holding frame against the plug-in direction, thus simplifying the installation of several plug connector modules.

It should be understood in that regard that an embodiment which is described in connection with a method according to the invention may also be understood as an embodiment of an apparatus according to the invention, and vice versa. Preferred and/or advantageous embodiments of the invention are derived not only from the definitions in the claims, but also from their further description and explanation. Like the other embodiments disclosed here, features of the embodiments defined in the claims can likewise be combined with each other, unless they mutually exclude certain features.

BRIEF DESCRIPTION OF THE SEVERAL VIEWS OF THE DRAWINGS

In the following, the invention shall be described in greater detail with reference to advantageous embodiments and to the enclosed Figures, in which.

DETAILED DESCRIPTION

Figure 1A:
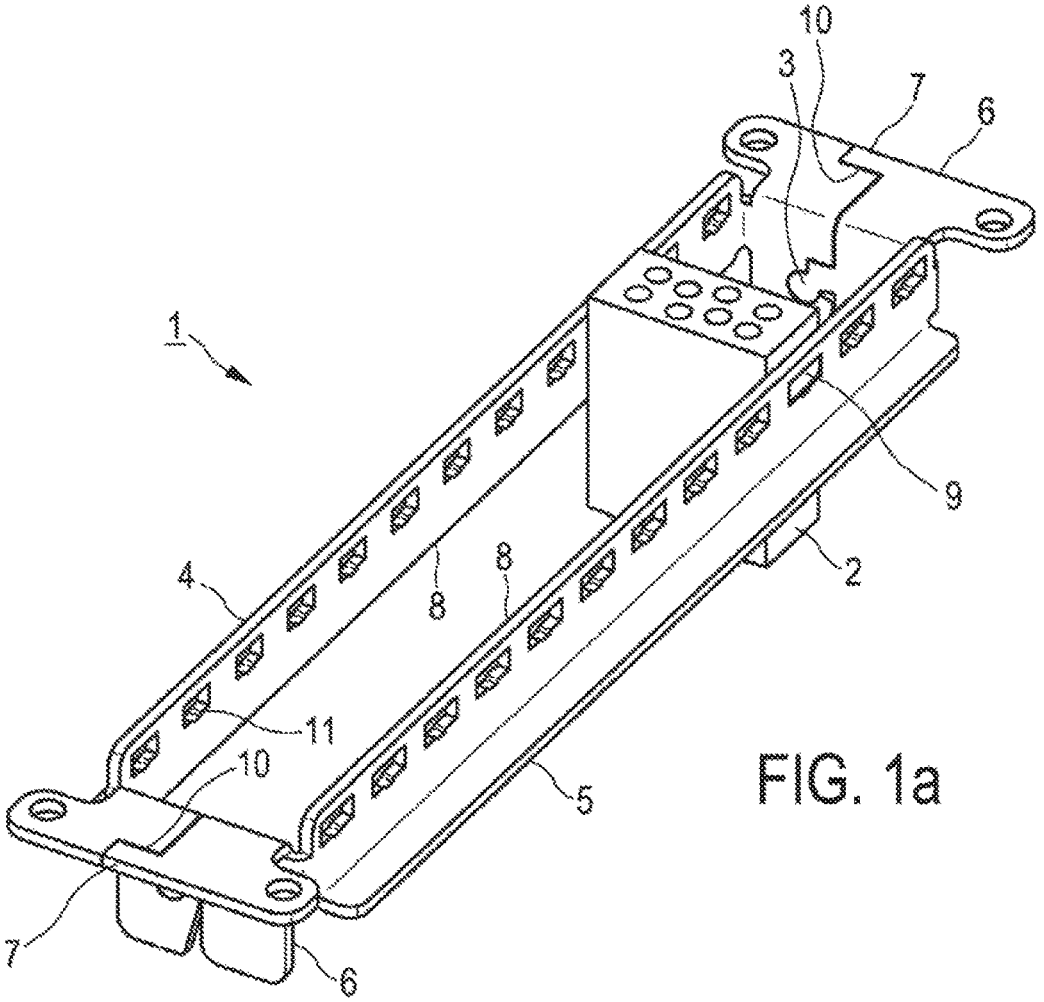
FIGS. 1*a*, 1*b* show views of a closed holding frame of an embodiment according to the invention.
Figure 1B:
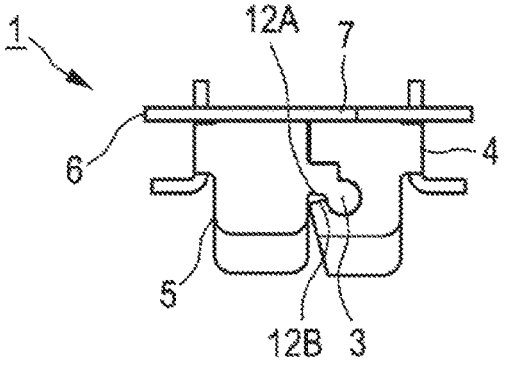
Figure 2A:
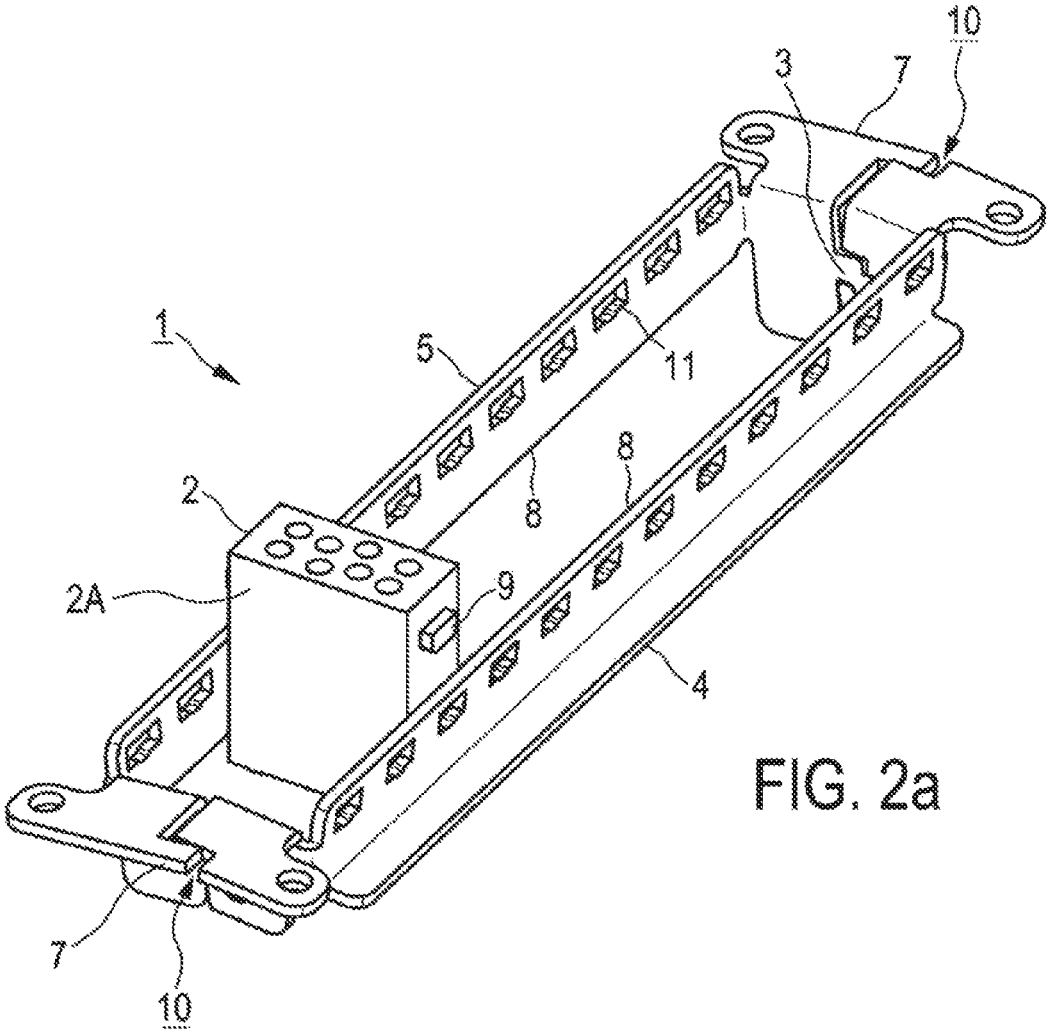
FIGS. 2*a*, 2*b* show views of the holding frame in Figs. la and lb, in the open state.
Figure 2B:
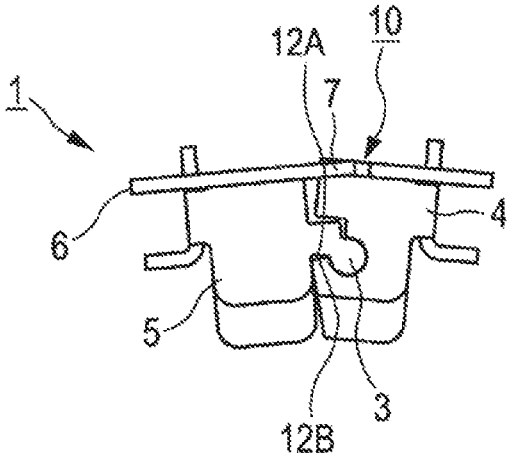

In FIGS. 1*a*, 1*b*, 2*a* and 2*b*, a holding frame 1 for plug connector modules 2 is shown schematically, the holding frame being open in FIGS. 2*a* and 2*b* and closed in FIGS. 1*a* and 1*b*.

Holding frame 1 is provided for installation, after insertion of plug connector modules 2, in a plug connector casing (see DE 19707120 C1 and EP 0860906 A2) or for fastening over a recess in an attachment surface or mounting wall.

Holding frame 1 comprises or consists of two holding frame areas 4, 5 connected via hinges 3 and having fastening ends 6 which can be provided with fastening screws (not shown), and side parts 8. Hinges 3 are provided at the fastening ends 6 of holding frame 1, and frame areas 4, 5 are able to pivot transversely to side parts 8 of holding frame 1 (as can be seen by comparing FIGS. 1*a*, 1*b* and 2*a*, 2*b*). To form hinges 3, molded portions which engage in matching recesses are provided in each case at the fastening ends 6 of holding frame 1. After the molded portions are inserted into the recesses, the side parts can be pivoted (rotatably) about a longitudinal axis.

Plug connector modules 2 comprise a main connector member 2A which is provided with projecting, approximately rectangular holding devices or means 9 and may additionally have resilient detent hooks (not shown). Recesses 11, in the form of openings which are bounded on all sides, are provided in the side parts 8 of frame halves 4, 5, and holding devices or means 9 are received in said recesses when plug connector modules 2 are inserted into holding frame 1.

To insert plug connector modules 2, holding frame 1 is flipped open, frame halves 4, 5 being flipped open so far about hinges 3 that plug connector modules 2 can be inserted. For preliminary fixing of plug connector module 2, the detent hooks that may be provided engage initially, on insertion, under the lower edges of side parts 8 of frame halves 4, 5. Frame halves 4, 5 are subsequently shut, i.e., holding frame 1 is closed, with the holding devices or means 9 entering recesses 11 in the process and producing secure, interlocking retention of plug connector modules 2 in holding frame 1. Fastening ends 6 each have a fastening section extending in the unscrewed state (see FIGS. 1*a*, 1*b*) parallel to the fastening area (not shown). In the case of FIG. 1*a*, the plane of extension of said fastening section extends horizontally and at right angles to the plane of the drawing. In the region of the fastening section, there are projections 7 and projections 10 in frame halves 5, 4 in this embodiment, which are in engagement with each other when the holding frame 1 is in the assembled state.

Figure 3:
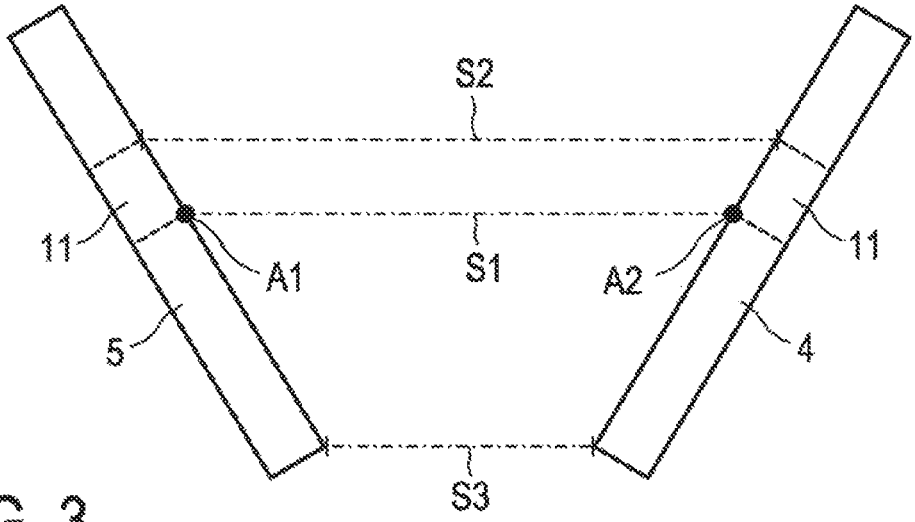
FIG. 3 shows a schematic sketch for defining the opening widths in the open state of the holding frame.

FIG. 3 shows a first example of an inventive holding frame 1 based on the basic design of a holding frame as described in FIGS. 1*a*-2*b*. FIG. 3 shows a schematic cross-section through the holding frame in a plug-in state. Side walls 4, 5, which extend in this Figure at right angles to the plane of the drawing, are shown as simple rectangles, but could also have other shapes. The cross-section chosen here runs exactly through a plane in which there is a recess 11 on either side of the holding frame.

In the embodiment described here, stops A1 and A2 located on either side are additionally drawn in. A stop in this context refers to a point at which the plug connector module 2 being installed comes into contact with the holding frame 1 and cannot be inserted any further into the holding frame 1 in the plug-in direction than the stopping point.

In one advantageous embodiment, the spacing between stops A1 and A2 on the respective frame areas 4, 5 is defined by a path S1. Path S1, which is also referred to as a first opening width, is defined such that stopping point A1, A2 is above a lower edge of recess 11.

The opening of the holding frame 1 in the plug-in state is also defined by a second opening width S2. The second opening width S2 is defined as the path between the upper edges of recesses 11 in opposite side walls of the side parts 8. The second opening width S2 is selected to be greater than the first opening width S1.

A third opening width S3 can be defined via the smallest distance between the opposite side walls which is this case is at the lower edge of side parts 8. The third opening width S3 is designed so that a plug connector module 2 can be inserted as far as necessary into holding frame 1.

Figure 4:
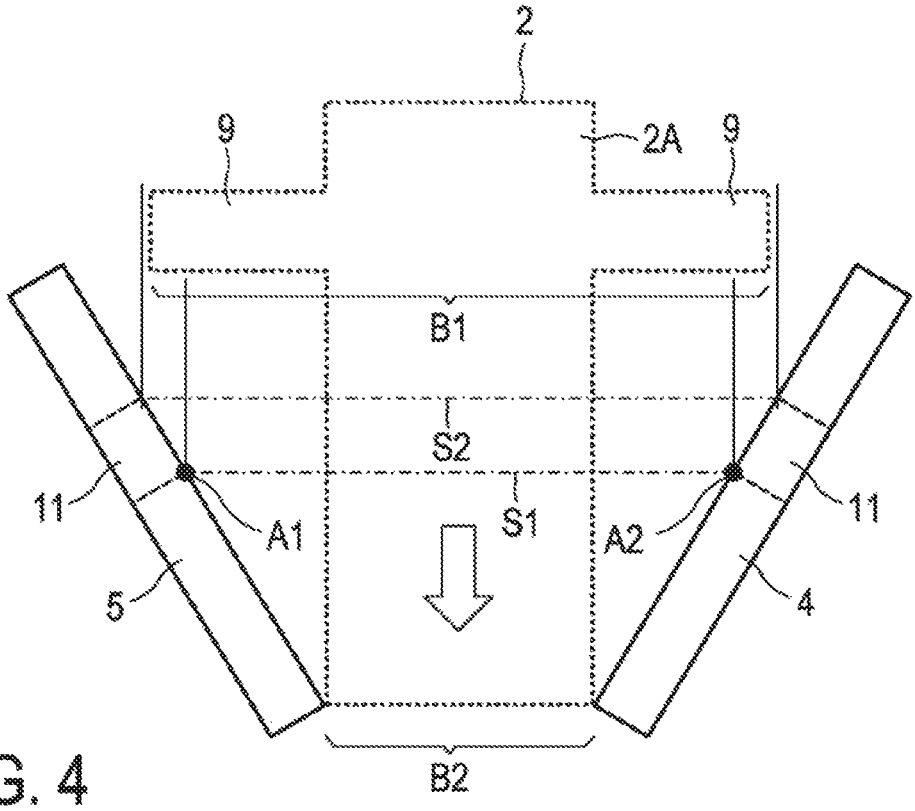
FIG. 4 shows another schematic view of the holding frame during installation of a plug connector module.

FIG. 4 shows how the definition of the first to third opening widths S1, S2, S3 allows simplified installation of plug connector modules 2.

Plug connector module 2 is characterised by a width B2 of the main part 2A of the plug connector module and by a width B1 between opposite ends of plug module holding devices or means 9. In order to install plug connector module 2, holding frame 1 is brought into the plug-in state, in compliance with the predetermined definition of the opening widths in the plug-in state. The third opening width S3 is defined such that the width of the main part 2A of the plug connector module can be inserted as far as the stop A1, A2 in holding frame 1. The first opening width S1 between stop A1 and stop A2 is defined such that it is smaller than width B1, which is defined by the outer edges of plug module holding devices or means 9. As a result, plug connector module 2 with plug module holding devices or means 9 comes up against the predefined stop A1, A2 in the course of insertion and cannot be inserted any further into holding frame 1. This ensures that, during installation, plug connector module 2 cannot slip through the lower opening in holding frame 1 and also that the stopping point for easy installation, i.e., for easy closure of the holding frame, is placed advantageously.

Figure 5:
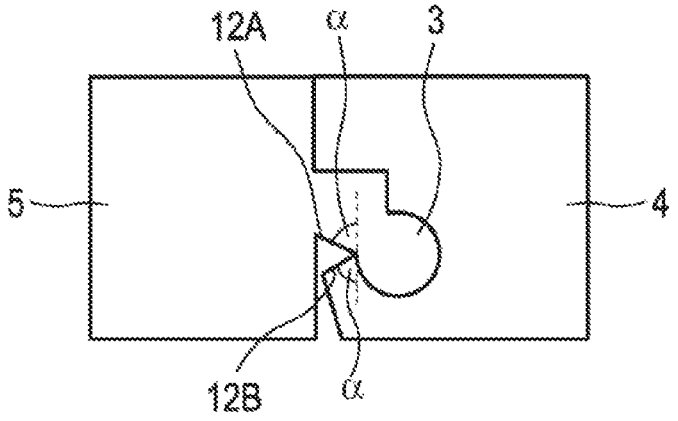
FIG. 5 shows a schematic, enlarged section of the hinged connection of the frame halves.

FIG. 5 shows an enlarged schematic section of hinged connection 3 of one advantageous embodiment. Hinged connection 3 is shown with holding frame 1 in a closed state. Hinged connection 3 comprises boundaries 12A and 12B, which are designed in such a way that they come into contact with each other when holding frame 1 is opened. Opening is possible only until there is contact between the two boundaries 12A, 12B, so contact between the two boundaries 12A, 12B defines the extent to which the holding frame 1 opens.

The two boundaries 12A, 12B are advantageously selected so that they form an angle $\alpha$ with the frame areas 4, 5. Said angle $\alpha$ defines how far the hinged connection 3 can be opened in a plug-in state. In an advantageous embodiment, the opening in the holding frame 1 in the plug-in state can be precisely adjusted by constructional means via angle $\alpha$.

Figure 6:
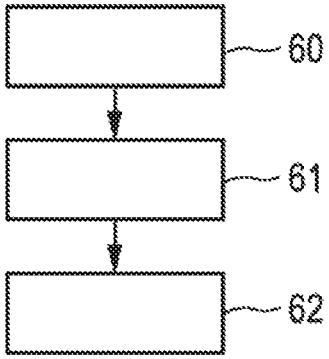
FIG. 6 shows a flow diagram illustrating an embodiment of a populating process according to the invention.

FIG. 6 shows a flow diagram illustrating an embodiment of a populating process according to the invention.

The method according to an embodiment of the invention for populating a holding frame with plug connector modules, in particular a holding frame as described above and shown in the Figures, comprises the following steps:

Firstly, in step 60, a plug-in state of the holding frame is provided, wherein the holding frame halves articulatedly connected to each other at fastening ends of the holding frame in the plug-in state are pivoted in relation to each other about a longitudinal axis in such a way that one or more plug connector modules can be inserted between the side parts thereof.

In the plug-in state, the holding frame can be populated with one or more plug connector modules in a populating step 61 by inserting the plug connector module as far as a stop.

Populating 61 is followed by providing, in step 62, a holding state of the holding frame, by pivoting the frame halves relative to the plug-in state so that the one or more inserted plug connector modules have a form-locking connection with the holding frame via plug module holding devices or means on the plug connector modules and via holding frame holding devices or means which are provided on opposite side parts of the holding frame, the plug connector modules remaining at the stop when the frame halves are pivoted.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame for holding plug connector modules, wherein the plug connector modules are insertable into the holding frame and plug module holding devices of the plug connector modules cooperate with holding frame holding devices provided on opposite side parts of the holding frame, wherein the holding frame includes two frame halves articulatedly connected to each other at fastening ends of the holding frame, the holding frame being divided along a line parallel to the side parts of the holding frame, the hinged connection allowing a plug-in state and a holding state of the holding frame, the frame halves in the plug-in state being pivoted in relation to each other about a longitudinal axis in such a way that one or more plug connector modules can be inserted between the side parts, and the frame halves in the holding state being pivoted in such a way relative to the plug-in state that one or more inserted plug connector modules have a form-locking connection with the holding frame via the holding frame holding devices, and wherein the holding frame the plug-in state has a stop for stopping the one or more plug connector modules on insertion into the holding frame, wherein the stop is so designed that when a plug connector module is stopped in the plug-in state, the holding frame holding devices and the plug module holding devices engage in each other in the holding state.

2. The holding frame according to claim 1, wherein the stop is located on the lower edge, in a plug-in direction, of the holding frame holding devices.

3. The holding frame according to claim 1, wherein the stop in the plug-in state is defined by a first opening width, the first opening width being a width between two opposite lower edges of the holding frame holding devices in the plug-in state.

4. The holding frame according to claim 3, wherein the first opening width is between 30.4 mm and 34.2 mm.

5. The holding frame according to claim 1, wherein the holding frame holding devices have a lower cut surface perpendicular to side surfaces of the side parts, on the lower edge in the plug-in direction.

6. The holding frame according to claim 1, wherein the one or more plug connector modules have detent hooks and wherein the stop is selected such that, when the one or more plug connector modules are stopped, the detent hooks of the one or more plug connector modules catch on lower edges of the side parts.

7. A holding system, comprising:

the holding frame according to claim 1, and one or more plug connector modules, wherein the plug connector modules have plug module holding devices, and wherein the holding frame is designed such that the plug module holding devices and the holding frame holding devices engage in each other in the holding state.

8. The holding frame according to claim 3, wherein the holding frame has a second opening width in the plug-in state, the second opening width being defined by the width between two opposite upper edges of the holding frame holding devices in a plug-in a direction, wherein the second opening width is wider than the first opening width.

9. The holding frame according to claim 8, wherein the first opening width is less than a dimension between two opposite outer edges of the plug module holding devices, and the second opening width is greater than the dimension between two opposite outer edges of the plug module holding devices.

10. The holding frame according to claim 8, wherein the second opening width is 34.4 mm.

11. The holding frame according to claim 8, wherein the holding frame has a third opening width in the plug-in state, the third opening width being defined on the basis of the smallest distance between the opposite side parts in the plug-in direction, wherein the third opening width is defined by the width of the main part of the plug connector module.

12. The holding frame according to claim 11, wherein the third opening width is 30.3 mm.

13. The holding frame according to claim 11, wherein the hinged connection is shaped in such a way that the predetermined first, second and third opening widths cannot be exceeded.

14. The holding frame according to claim 13, wherein the hinged connection has a first boundary and a second boundary, the first boundary belonging to the first side part and the second boundary belonging to the second side part, such that the first and the second boundary come into contact when the holding frame is in the plug-in state.

15. The holding frame according to claim 14, wherein the first and second boundaries define an angle to the side parts such that the predetermined opening widths are not exceeded in the plug-in state.

16. A method for populating a holding frame with plug connector modules, wherein the holding frame comprises two frame halves and is divided along a line parallel to side parts of the holding frame, the method comprising:

providing a plug-in state of the holding frame, the frame halves articulatedly connected to each other at fastening ends of the holding frame in the plug-in state being pivoted in relation to each other about a longitudinal axis in such a way that one or more plug connector modules can be inserted between the side parts;

populating the holding frame in the plug-in state with one or more plug connector modules by inserting the one or more plug connector modules as far as a stop; and providing a holding state of the holding frame by pivoting the frame halves relative to the plug-in state, such that the one or more inserted plug connector modules have a form-locking connection with the holding frame via plug module holding devices on the plug connector modules and via holding frame holding devices which are provided on opposite ones of the side parts of the holding frame, the one or more plug connector modules remaining at the stop when pivoted.

* * * * *